US006155349A

United States Patent [19]

Robertson et al.

[11] Patent Number: 6,155,349

[45] Date of Patent: Dec. 5, 2000

[54] FLEXIBLE WELLBORE MILL

[75] Inventors: Robert Robertson, Tomball; Thurman B. Carter, Houston; Timothy Wilson, Houston; William A. Blizzard, Jr., Houston; Guy L. McClung, III, Spring, all of Tex.

[73] Assignee: Weatherford/Lamb, Inc., Houston, Tex.

[21] Appl. No.: 09/033,970

[22] Filed: Mar. 3, 1998

Related U.S. Application Data

[63] Continuation-in-part of application No. 08/642,118, May 2, 1996, and a continuation-in-part of application No. 08/752,359, Nov. 19, 1996, Pat. No. 5,787,978.

[51] Int. Cl.[7] ..... E21B 43/11

[52] U.S. Cl. ..... 166/298; 166/55.7

[58] Field of Search ..... 166/298, 55.7, 166/55.1, 55.6

[56] References Cited

U.S. PATENT DOCUMENTS

| | | | |
|---|---|---|---|
| 1,045,954 | 12/1912 | Decker . | |
| 1,524,265 | 1/1925 | Lester | 294/86.22 |
| 1,570,518 | 1/1926 | Mitchell | 166/117.5 |

(List continued on next page.)

FOREIGN PATENT DOCUMENTS

| | | | |
|---|---|---|---|
| 0 338 965 A1 | of 1988 | European Pat. Off. | A61B 17/22 |
| 0 397 417 | of 1989 | European Pat. Off. | E21B 10/32 |

OTHER PUBLICATIONS

PCT/GB97/03104—Foreign Counterpart of this case U.S. 08/752,359—Invitation to Pay Additional Fees with Communication Relating To The Results of the Partial Int'l Search.

"1990—91 General Catalog, " A–1 Bit & Tool Co. p. 9, 1990.

"TIW's SS–WS Whipstock Pakcer," Texas Iron Works, p. 111.9.18; 1986.

"Coring Services," Weatherford, 1994.

"Casing Whipstocks," Eastman Whipstock, Composite Catalog 1976–1977, p. 2226.

"Product Catalog," Weatherford Petco, 1992, especially pp. 26–30.

"Bowen Whipstocks," Bowen Co., Composite Catalog, 1962–1963.

"Directional Drilling Tools," Homco Associated Oil Field Rentals, Composite Catalog 1964–1965, pp. 2391, 2392, 2394.

"Oilfield Services And Manufactured Products," Homeco, 1984.

"A–Z Stub Type Whipstock," A–Z Int'l Tool Co., 1976–1977 Composite Catalog, p. 219.

"Weatherford Fishing and Rental Tool Services," Weatherford, 1993.

"Improved Casing Sidetrack Procedure Now Cuts Wider, Longer Windows," Cagle et al, Petroleum Engr. Int'l, Mar. 1979.

(List continued on next page.)

*Primary Examiner*—William Neuder
*Attorney, Agent, or Firm*—Guy McClung

[57] ABSTRACT

A wellbore mill has been invented having a flexible main body, and at least one milling apparatus secured on the flexible main body. A wellbore mill has been invented having a main body with a top end and a bottom end, at least one milling structure on the mill body, and a stinger projecting down from and releasably secured to the bottom end of the mill body. Methods have been invented for milling wellbore tubulars with such mills. A method for eliminating tubular offset in a wellbore has been invented, and the method includes positioning a wellbore mill in a tubular offset of a tubular string in a wellbore, the wellbore mill comprising a flexible main body and at least one milling apparatus secured on the flexible main body, and rotating the wellbore mill to mill at least part of the tubular offset.

27 Claims, 8 Drawing Sheets

U.S. PATENT DOCUMENTS

| | | | |
|---|---|---|---|
| 1,615,037 | 1/1927 | Raymond . | |
| 1,636,032 | 7/1927 | Abbott . | |
| 1,698,496 | 1/1929 | Gray . | |
| 1,804,819 | 5/1931 | Spencer, Jr. et al. . | |
| 1,901,453 | 3/1933 | Kelly . | |
| 1,951,638 | 3/1934 | Walker . | |
| 2,014,805 | 9/1935 | Hinderliter . | |
| 2,065,896 | 12/1936 | Keever . | |
| 2,100,684 | 11/1937 | Carroll . | |
| 2,103,622 | 12/1937 | Kinzback . | |
| 2,105,721 | 1/1938 | Cutrer et al. . | |
| 2,105,722 | 1/1938 | Barrett et al. . | |
| 2,108,419 | 2/1938 | Trotter . | |
| 2,158,329 | 5/1939 | Kinzback . | |
| 2,196,517 | 4/1940 | Bolton . | |
| 2,216,963 | 10/1940 | Sinclair | 175/82 |
| 2,267,833 | 12/1941 | McMahan . | |
| 2,281,414 | 4/1942 | Clark . | |
| 2,296,939 | 9/1942 | McMahan . | |
| 2,331,293 | 10/1943 | Ballard . | |
| 2,362,529 | 11/1944 | Barrett et al. | 166/117.6 X |
| 2,386,514 | 10/1945 | Stokes | 175/81 |
| 2,401,893 | 6/1946 | Williams, Jr. | 175/81 |
| 2,509,144 | 5/1950 | Grable . | |
| 2,553,874 | 5/1951 | Spaulding et al. . | |
| 2,554,780 | 5/1951 | Goolsbee . | |
| 2,644,672 | 7/1953 | Mathews . | |
| 2,667,332 | 1/1954 | McCune et al. . | |
| 2,668,463 | 9/1954 | Bettes . | |
| 2,680,483 | 6/1954 | Le Bus | 166/55.7 |
| 2,685,431 | 8/1954 | James . | |
| 2,716,542 | 3/1955 | Gable . | |
| 2,766,010 | 10/1956 | Hester | 166/217 |
| 2,770,444 | 11/1956 | Neal . | |
| 2,807,440 | 9/1957 | Beck . | |
| 2,882,015 | 4/1959 | Beck . | |
| 2,885,182 | 5/1959 | Hering | 255/1.6 |
| 2,939,531 | 6/1960 | Hall . | |
| 2,956,626 | 10/1960 | Hall . | |
| 2,978,032 | 4/1961 | Hanna | 166/117.5 |
| 3,095,039 | 6/1963 | Kinzback | 166/117.6 |
| 3,172,488 | 3/1965 | Roxstrom . | |
| 3,570,598 | 3/1971 | Johnson | 166/178 |
| 3,732,924 | 5/1973 | Chelette et al. | 166/55 |
| 3,903,974 | 9/1975 | Cullen | 175/17 |
| 3,908,759 | 9/1975 | Cagle et al. | 166/117.6 |
| 4,043,390 | 8/1977 | Glotin | 166/215 |
| 4,182,423 | 1/1980 | Ziebarth et al. | 175/61 |
| 4,266,621 | 5/1981 | Brock | 175/329 |
| 4,368,786 | 1/1983 | Cousins | 175/78 |
| 4,397,355 | 8/1983 | McLamore | 166/297 |
| 4,397,360 | 8/1983 | Schmidt | 175/61 |
| 4,415,205 | 11/1983 | Rehm et al. | 299/5 |
| 4,420,049 | 12/1983 | Holbert | 175/45 |
| 4,699,224 | 10/1987 | Burton | 175/61 |
| 4,717,290 | 1/1988 | Reynolds et al. | 407/34 |
| 4,733,732 | 3/1988 | Lynch | 175/9 |
| 4,796,709 | 1/1989 | Lynde et al. | 166/55.6 |
| 4,807,704 | 2/1989 | Hsu et al. | 166/313 |
| 4,848,462 | 7/1989 | Allwin | 166/208 |
| 4,887,668 | 12/1989 | Lynde et al. | 166/55.8 |
| 4,904,228 | 2/1990 | Frear et al. | 464/162 |
| 4,938,291 | 7/1990 | Lynde et al. | 166/55.8 |
| 4,978,260 | 12/1990 | Lynde et al. | 166/55.6 |
| 4,984,488 | 1/1991 | Lunde et al. | 166/55.6 |
| 5,010,955 | 4/1991 | Springer | 166/298 |
| 5,014,778 | 5/1991 | Lynde et al. | 166/55.6 |
| 5,035,292 | 7/1991 | Bailey et al. | 175/45 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,148,877 | 9/1992 | MacGregor | 175/79 |
| 5,150,755 | 9/1992 | Cassel et al. | 166/297 |
| 5,181,564 | 1/1993 | Lindley et al. | 166/55.6 |
| 5,197,767 | 3/1993 | Kimura et al. | 385/39 |
| 5,199,513 | 4/1993 | Stewart et al. | 175/73 |
| 5,253,710 | 10/1993 | Carter et al. | 166/298 |
| 5,289,876 | 3/1994 | Graham | 166/276 |
| 5,297,630 | 3/1994 | Lynde et al. | 166/297 |
| 5,301,760 | 4/1994 | Graham | 175/61 |
| 5,335,737 | 8/1994 | Baugh | 175/61 |
| 5,337,808 | 8/1994 | Graham | 166/191 |
| 5,341,873 | 8/1994 | Carter | 166/117.5 |
| 5,373,900 | 12/1994 | Lynde et al. | 166/297 |
| 5,379,845 | 1/1995 | Blount et al. | 166/382 |
| 5,392,858 | 2/1995 | Peters et al. | 166/298 |
| 5,398,754 | 3/1995 | Dinhoble | 166/117.6 |
| 5,407,011 | 4/1995 | Layton | 166/376 |
| 5,409,060 | 4/1995 | Carter | 166/237 |
| 5,425,417 | 6/1995 | Carter | 166/117.6 |
| 5,425,419 | 6/1995 | Sieber | 166/206 |
| 5,427,179 | 6/1995 | Bailey et al. | 166/117.6 |
| 5,429,187 | 7/1995 | Beagrie et al. | 166/55.1 |
| 5,431,220 | 7/1995 | Lennon et al. | 166/55.7 |
| 5,435,400 | 7/1995 | Smith | 175/61 |
| 5,437,340 | 8/1995 | Lee et al. | 175/61 |
| 5,443,129 | 8/1995 | Bailey et al. | 175/45 |
| 5,445,222 | 8/1995 | Pritchard et al. | 116/298 |
| 5,452,759 | 9/1995 | Carter et al. | 166/117.6 |
| 5,456,312 | 10/1995 | Lynde et al. | 166/55.6 |
| 5,462,120 | 10/1995 | Gondouin | 166/117.6 |
| 5,467,820 | 11/1995 | Sieber | 166/117.6 |
| 5,474,126 | 12/1995 | Lynde et al. | 166/117.6 |
| 5,477,925 | 12/1995 | Trahan et al. | 166/382 |
| 5,484,021 | 1/1996 | Hailey | 166/297 |
| 5,499,680 | 3/1996 | Walter et al. | 166/377 |
| 5,544,704 | 8/1996 | Laurel et al. | 166/117.6 |
| 5,551,509 | 9/1996 | Braddick | 166/55.7 |
| 5,564,503 | 10/1996 | Longbottom et al. | 166/313 |
| 5,566,762 | 10/1996 | Braddick et al. | 166/382 |
| 5,566,763 | 10/1996 | Williamson et al. | 166/382 |
| 5,573,064 | 11/1996 | Hisaw | 166/250.07 |
| 5,595,247 | 1/1997 | Braddick | 166/297 |
| 5,620,051 | 4/1997 | Carter et al. | 166/298 |
| 5,647,436 | 7/1997 | Braddick | 166/298 |
| 5,647,437 | 7/1997 | Braddick et al. | 166/382 |
| 5,651,415 | 7/1997 | Scales | 166/250.09 |
| 5,657,820 | 8/1997 | Bailey et al. | 166/55.7 |
| 5,697,438 | 12/1997 | Rehbock et al. | 155/55.7 |
| 5,697,445 | 12/1997 | Graham | 166/313 |
| 5,715,891 | 2/1998 | Graham | 166/313 |
| 5,730,221 | 3/1998 | Longbottom et al. | 155/298 |
| 5,730,224 | 3/1998 | Williamson et al. | 166/386 |
| 5,732,773 | 3/1998 | Parks et al. | 166/117.5 |
| 5,735,350 | 4/1998 | Longbottom et al. | 166/313 |
| 5,787,978 | 8/1998 | Carter et al. | 166/55.7 |
| 5,806,595 | 9/1998 | Langford et al. | 166/298 |
| 5,881,816 | 3/1999 | Wright | 166/55.7 |

OTHER PUBLICATIONS

"Dual Horizontal extension drilled using retrievable whipstock," Cress et al, World Oil, Jun. 1993.

"Catalog 1958–1959," Kinzbach Tool Co., Inc., pp. 6, 7, 8; 1958.

"General Catalog 68–69," A–1 Bit & Tool Co., p. 136.

"Who Has Mills That Are Diamond Tough," Homco, 1974.

"Uss American Tiger Brand Wire Rope," Composite Catalog 1962–1963, pp. 229–232.

"Angus Products For The Oil Inductry," Composite Catalog 1962–1963, p. 233.

"American Cable True–Lay VHS," American Chain & Cable Co., Composite Catalog, 1962–1963, p. 203.

FIG. 1C
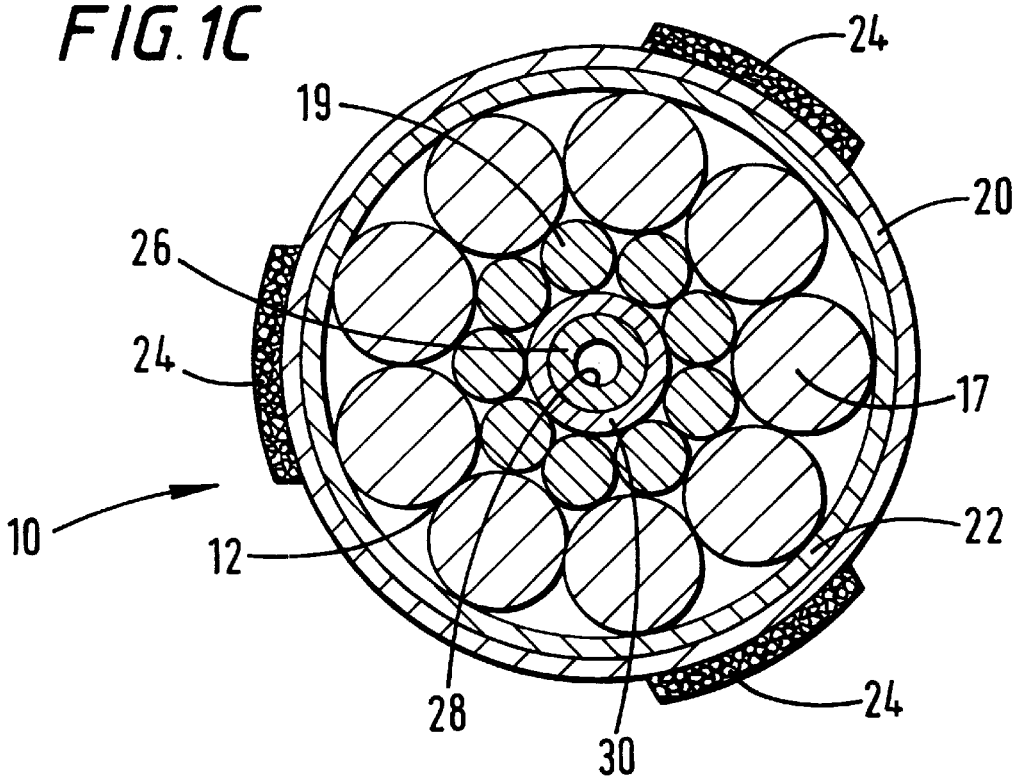
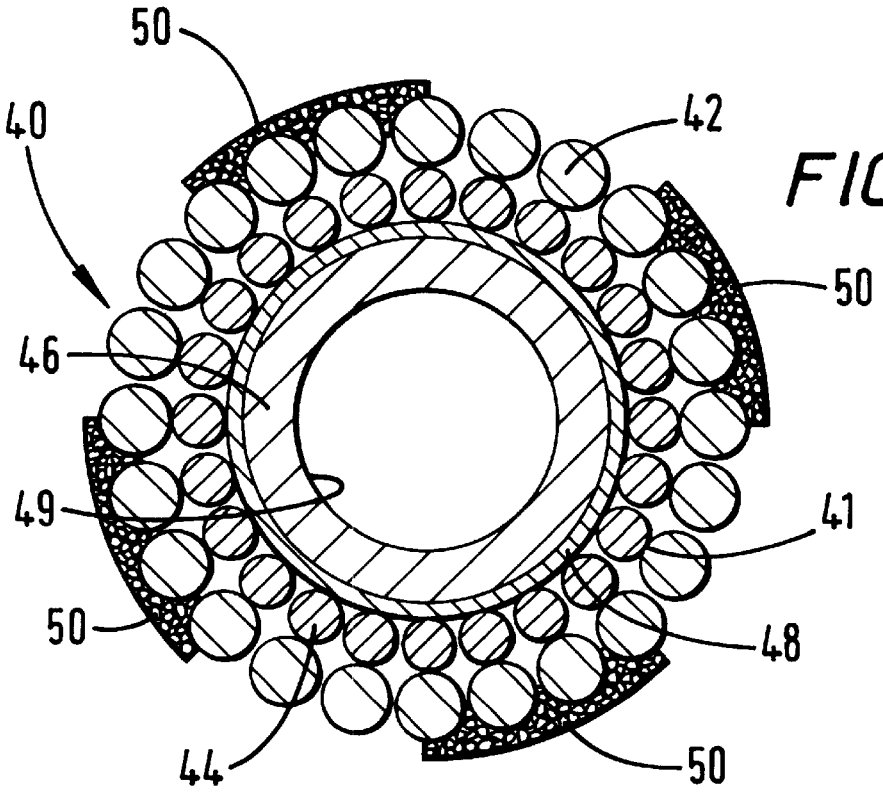
FIG. 1D

FLEXIBLE WELLBORE MILL

RELATED APPLICATION

This is a continuation-in-part of U.S. Application Ser. No. 08/642,118 filed May 2, 1996 entitled "Wellbore Milling System And Method" and of U.S. Application Ser. No. 08/752,359 filed Nov. 19, 1996, Now U.S. Pat. No 5,787,978, entitled "Multi-Face Whipstock With Sacrificial Face Element," both co-owned with the present invention and incorporated fully herein for all purposes.

BACKGROUND OF THE INVENTION

1. Field of the Invention

This invention is directed to wellbore mills and methods of their use; in one aspect to wellbore mills with a flexible body; and in another aspect to a method employing such a mill to mill within a deformed bent wellbore tubular.

2. Description of Related Art

In a variety of wellbore situations a tubular string within the wellbore is not straight, but has portions therein that are deformed, bent, partially collapsed, or pinched. For example, subsidence occurring in a formation through which a cased wellbore extends can shift a portion of the casing creating a severe offset. Passing wellbore apparatuses and wellbore tubulars, e.g. production tubing, through such an offset is difficult or impossible.

There has long been a need for a method and system for correcting restrictive wellbore tubular offsets. There has long been a need for a method and system for traversing wellbore tubular offsets.

SUMMARY OF THE PRESENT INVENTION

The present invention, in certain embodiments, discloses a wellbore mill with a flexible body with one or more milling apparatuses thereon. The flexible body can be an articulable tubular member or interconnected series of tubular members. In one aspect the flexible body is a multi-strand flexible metal cable, e.g., but not limited to a cable made of strands of steel, stainless steel, bronze, zinc, aluminum, alloys of any of these metals, or any combination thereof. The articulable tube may also be made of such materials.

In certain embodiments milling apparatus is secured to a flexible wire rope or metal cable by attaching a plurality of spaced-apart metal sleeves on the cable's exterior (e.g. by crimping and/or welding) and then applying matrix milling material on the sleeves and/or milling inserts. Herein when matrix milling material and/or milling inserts are used these terms include, but are not limited to, any known matrix milling material and any known milling inserts applied in any known way in any known pattern, array, or combination. In one aspect, left hand lay wire rope is used for the cable. Alternatively, milling material and/or inserts may be applied directly onto wire cable.

In one aspect the flexible body of the mill is essentially solid. In another aspect the flexible body has a flexible or an articulable tubular extending through the body from one end to the other. In certain such embodiments a sealing tube surrounds an articulable tubular within the mill or a sealing tubular (made e.g. of plastic or flexible metal) so that fluid under pressure can flow through the mill. In one particular aspect, a metal tubular has a series of spaced-apart cuts made by a suitable cutter or by a laser that renders the tubular sufficiently articulable to traverse a wellbore casing or tubing offset or to enter such an offset to mill away portions thereof. In another aspect, a series of tubulars one on top of the other are positioned in a bore in a cable. They can be surrounded by and encompassed within an outer sealing tubular or such a sealing tubular can be used extending within and through bores in each of the series of tubulars. Fluid circulation through a bore of an articulable member or through a sealing tubular within an articulable member or members provides for circulation from the mill into the wellbore annulus to circulate cuttings and debris away from the mill and/or to cool the mill. Any suitable wellbore or drilling fluid may be used, including, but not limited to, clean brine. In one aspect one or more weight members may be connected at the bottom of the mill.

The present invention discloses a method for using a mill as described above to enter a casing offset and mill away portions thereof. A liner is then introduced and positioned so that the milled away areas are covered. The liner is not at as extreme an angle as was the original casing offset, thus facilitating the passage therethrough of wellbore devices and tubulars. Optionally, prior to liner insertion, the flexible mill is removed and a second mill system with a lower stinger is run into the wellbore so that the stinger passes beyond the milled out area to position and stabilize one or more mills of the system adjacent the milled out area for further enlargement thereof. A mill body has a hollow portion for swallowing the stinger during milling. The stinger is initially shear pinned to the mill body. The pin is sheared by downward force. The second mill system, in one aspect, includes a lower guide mill or guide mill portion with one, two, three, four or more helices of milling matrix material therearound and an upper laced collar portion with a single, double, triple, or quadruple helix of matrix milling material therearound. Use of a single helix on the laced collar portion facilitates emplacement of a tong around the milling portions. Typically a mill according to the present invention mills by being rotated by any known rotation apparatus, method, and/or system. Alternatively, such a mill may mill by alternately pushing and pulling on the mill.

It is, therefore, an object of at least certain preferred embodiments of the present invention to provide:

New, useful, unique, efficient, nonobvious devices and methods for a flexible wellbore mill;

Such a mill which is useful to mill away part of a casing offset to render it again traversable by wellbore apparatuses or tubulars;

Such a mill with replaceable milling apparatus which are releasably securable to a flexible mill body;

Such a mill with an inner hollow tubular which provides a fluid flow path through the mill;

Such a mill in which the inner hollow tubular is itself flexible; and

Such a mill usable in combination with another mill system having a stinger therebelow for positioning and stabilizing a mill or mills of the system adjacent an area milled out by the flexible mill for enlargement thereof.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 1C and 1D are cross-section views of mills according to the present invention.

DESCRIPTION OF EMBODIMENTS PREFERRED AT THE TIME OF FILING FOR THIS PATENT

Figure 1A:
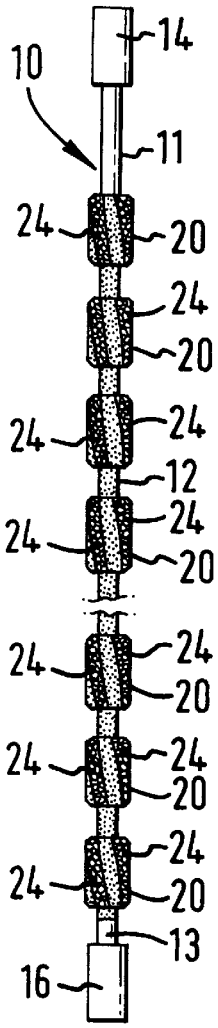
FIG. 1A is a side view of a wellbore mill according to the present invention.
Figure 1B:
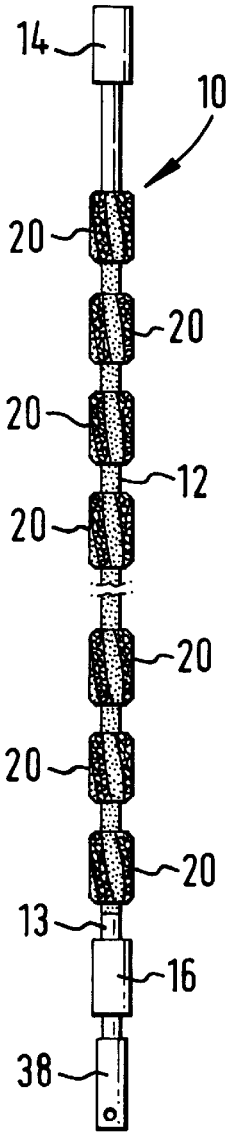
FIG. 1B is a side view of a wellbore mill according to the present invention.

As shown in FIG. 1A–1C, a mill 10 according to the present invention has a main body 12 that is flexible. As shown the main body 12 is a flexible multi-strand metal cable including a plurality of metal strands 17 and 19, but it is within the scope of this invention to use any suitable flexible member which flexes either due to its material and dimensions and/or flexes due to recesses, grooves, cut, dimples and/or indentations thereon, therein, and/or therethrough. A top sub 14 is connected, e.g. by welding or epoxy, to a top end 11 of the main body 12 and a bottom sub 16 is connected to a bottom end 13 of the main body 12. The subs may have appropriate threads for connection to other tubulars, strings, or other apparatuses. The main body 12 may be sufficiently small in outer diameter to serve as a fishing member or fishing neck. Alternatively, a separate fishing member may be used on top of the body 12.

A plurality of milling structures 20 are secured, e.g. by welding, to sleeves 22 which are secured to the main body 12, e.g. by crimping, friction fit or welding. Matrix milling material 24 is applied to the exterior surface of the milling structures 20, in one aspect spirally about the structures 20 as shown. If desired milling blades may be used on the milling structures 20 with or without milling matrix material and/or milling inserts. Alternatively substantially all of the exterior surface of the milling structures 20 is covered with milling matrix material and/or milling inserts.

Extending from top to bottom in the main body 12 is an articulable member 26 with a fluid flow bore 28 therethrough from top to bottom. An optional tubular 30, e.g. made of plastic (or suitable flexible metal, composite, or fiberglass, e.g.) encases the articulable member 26. In certain embodiments in which the articulable member 26 has cuts therein or therethrough, the tubular 30 seals such cuts so that fluid flow through the bore 28 is passible without leakage through the cuts.

It is to be understood that the various components as shown in FIGS. 1A and 1C may have any suitable dimensions. Also any suitable cable may be used with any desired number of individual strands having any desired cross-section and made from any desired cross-section and made from any desired material that is strong enough to withstand the rigors of milling and passage through tubulars in a wellbore. It is also to be understood that a cable with a solid center and/or made completely of solid strands is usable with mills within the scope of this invention.

FIG. 1B illustrates an alternative version of the mill 10. A weight member 38 is connected to the bottom sub 16 (or alternatively, the weight member 38 is connected directly to the bottom end 13 of the mill body 12). The weight member may be solid; it may have a fluid flow bore therethrough; and/or it may have any structure and configuration for any weight member disclosed herein.

The break in the mill body 12 in FIGS. 1A and 1B indicates that it may be any desired length and that any desired number of structures 20 may be used.

In one embodiment the sleeves 22 are slipped over the cable and then crimped in place (They may also be welded to the cable or only welded.) The mill structures 20 are then slid over the sleeves 22 and welded in place. Alternatively a sleeve which is originally open is wrapped onto the cable and crimped in place.

FIG. 1D shows an alternative structure for a main body of a mill 40 according to the present invention. A cable 41 is made of individual strands 42 and 44. A bendable central tubular member 46 extends through the mill 40 from top to bottom and, optionally, is surrounded sealingly by a tubular member 48. Matrix milling material 50 is applied to the strands of the cable 41 either spirally as in FIG. 1A or vertically (or in any other desired configuration). In certain embodiments as shown, the matrix milling material 50 flows between strands of the cable 41. Alternatively the entire exterior cable surface may be covered with matrix milling material and/or milling inserts and/or any combination thereof; or such milling structure may be applied in a spaced-apart manner to the cable's exterior (spaced-apart, e.g., as are the structures 20, FIG. 1A). Optionally, a fluid flow bore 49 extends through the mill 40 from top to bottom.

Figure 2:
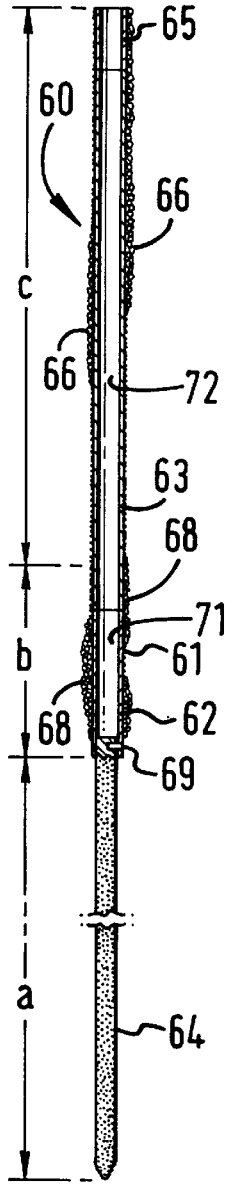
FIG. 2 is a side view of a wellbore mill according to the present invention.

FIG. 2 illustrates a mill system 60 according to the present invention with a mill body 61, a lower guide mill 62 secured on or formed of the mill body 61, an upper laced collar 63 secured to or formed of the mill body 61, a top sub 65, and a stinger 64 initially secured to the mill body 61 with a shear pin 69. The lower guide mill 62 and the upper laced collar 63 are hollow, each with a bore 71, 72 therethrough, respectively, from top to bottom suitable for receiving the stinger 64 during milling following shearing of the shear pin 69. The mill system 60 is suited, among other things, for movement into an offset that has previously been milled by a mill such as that of FIG. 1A. The stinger 64 can be moved through the offset so that at least a portion of the stinger 64 extends into a non-offset portion of the tubulars. In this way the mill system 60 is correctly located; the tendency of a mill to engage stub ends created in the previous milling is inhibited or eliminated; and the mill system 60 is stabilized at the desired location. During milling the stinger 64 acts as a stabilizer and it maintains desired system position. In one particular embodiment, the stinger 64 has an outside diameter of about 2⅞ inches and its length a is about 30 feet; the guide mill 62 has an outer diameter of about 6¹⁄₁₆ inches and its length b is about 18 inches; and the laced collar 63 has an outer diameter of about 6¹⁄₁₆ inches and its length c is about 15 feet; and such a mill is useful in a casing with an inner diameter of about 6.25 inches.

In one aspect the laced collar 63 is a drill collar to which is applied matrix milling material 66 (and/or milling inserts). Such material 68 is also applied to the guide mill 62.

Figure 3:
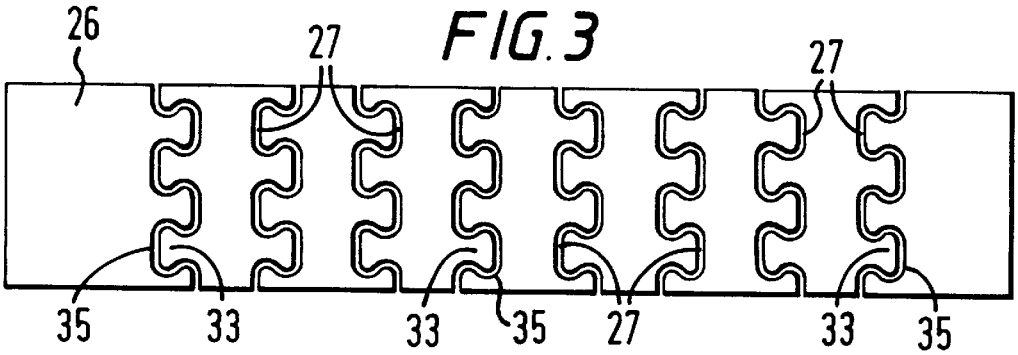
FIG. 3 is an unwrapped side view of part of an articulable member of a wellbore mill according to the present invention.

FIG. 3 shows one embodiment of the articulable member 26 of the mill 10, FIG. 1A. FIG. 3 depicts a portion of the articulable member 26 that is cut and flattened out. Cuts 27 through the member provide a series of interlocking lobes 33 and corresponding recesses 35 which are movable with respect to each other and which render the member flexible.

Figure 4C:
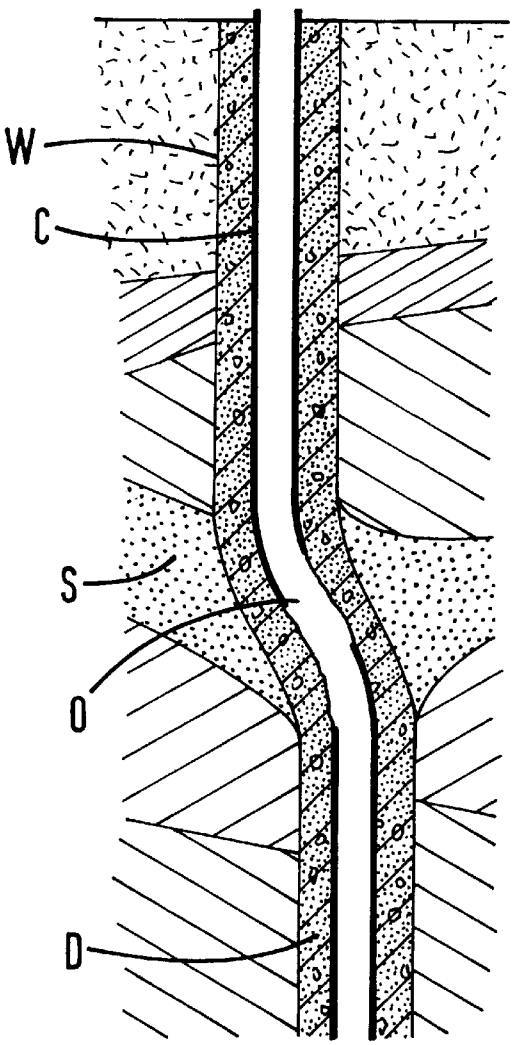
FIG. 4C shows the offset of FIG. 4A following milling by the wellbore mill of FIG. 4B.
Figure 4B:
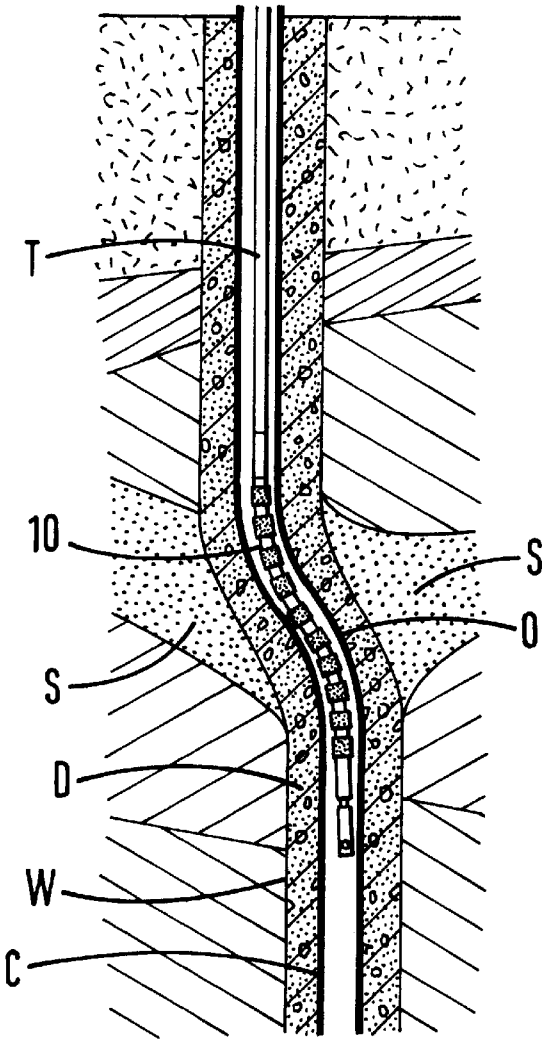
FIG. 4B shows a wellbore mill according to the present invention in the offset of FIG. 4A.
Figure 4A:
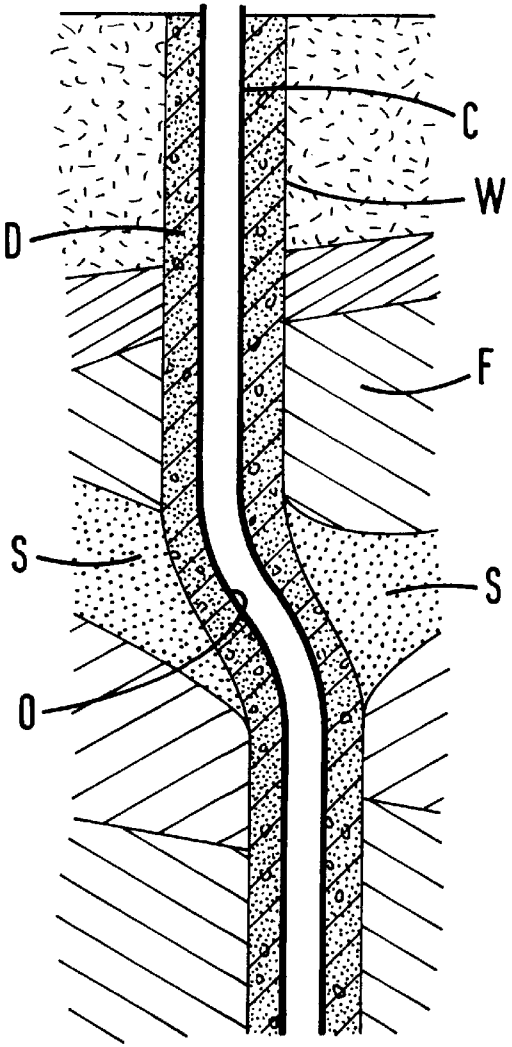
FIG. 4A is a side cross-section view of a casing offset in a cased wellbore.

FIGS. 4A–4C depict an operation according to the present invention with a mill 10. FIG. 4A shows a cased wellbore W in the earth cased with casing C and cemented in place with cement D. As originally drilled, the wellbore W was substantially vertical. As shown in FIG. 4A, subsidence zone S has been created in an earth formation F, resulting in the pinching of casing C creating offset portion O of the casing. As shown in FIG. 4B a mill 10 on a tubular (e.g. drill pipe which is part of a drill string) T has been introduced into the wellbore W and positioned with its milling structures adjacent the offset portion O. Known locating techniques and/or devices may be used for such locating (such a mill may be used on a cable or wireline). The mill 10 is then rotated by rotating the tubular string and portions of the offset casing are milled away as shown in FIG. 4C which shows that the mill 10 has been removed from the wellbore W.

Figure 5C:
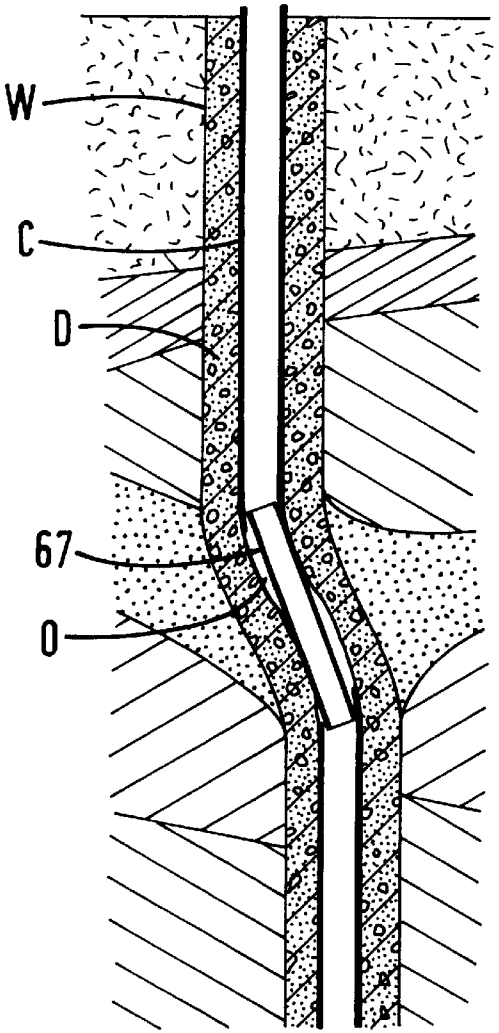
FIG. 5C shows a liner installed in the wellbore.
Figure 5B:
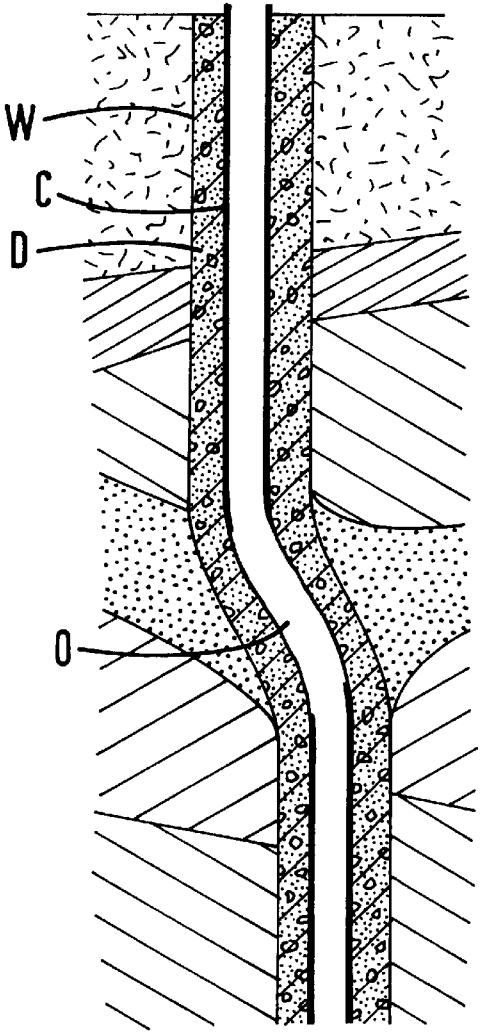
FIG. 5B shows further milling of the offset of FIG. 4A by the wellbore mill shown in FIG. 5A.
Figure 5A:
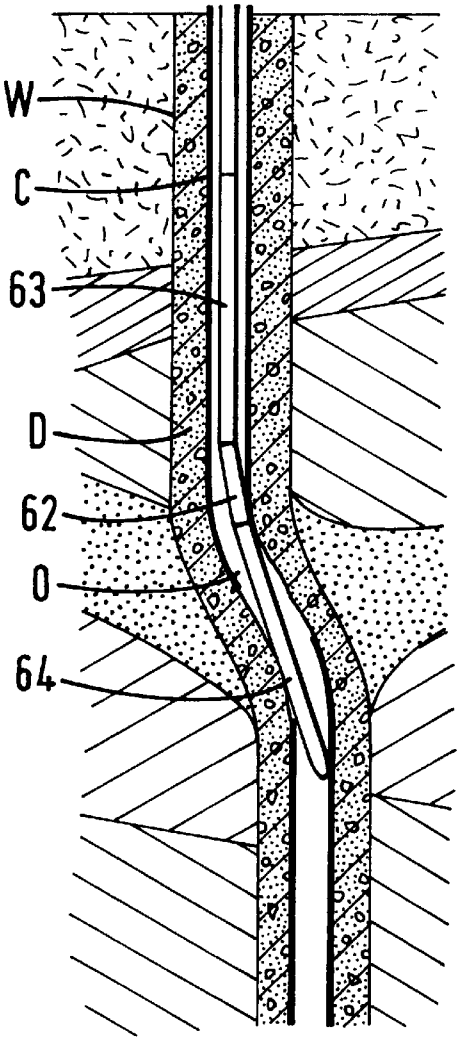
FIG. 5A is a copy of FIG. 4C with another wellbore mill therein according to the present invention.

As shown in FIG. 5A a mill system 60 has been run into the wellbore W and positioned with respect to the offset O with its stinger 64 extending down in the casing C past the offset O. Rotation of the mill system 60 (e.g. by an hydraulic or power swivel) removes more of the offset casing. The mill system 60 is then removed from the wellbore (see FIG. 5B). Then a liner 67 (see FIG. 5C) connected e.g. to a setting tool and/or to an entire string of casing is moved into the casing C and positioned across the milled off portion of the offset. The liner 67 is secured in place by any known suitable liner securement device or apparatus and is, in one aspect, sealed at either end by any known suitable seal mechanism or device. Movement of apparatuses and/or tubulars through offset is thus facilitated.

A fishing member or member with a fish neck may be located above or below a top sub of a mill according to the present invention; e.g. as (see mill 10 of FIG. 1A), in one aspect, the top sub 14 is releasably connected to the top 11 of the main body 12 by one or more shear pins and the top 11 acts as a fishing member.

Figure 6:
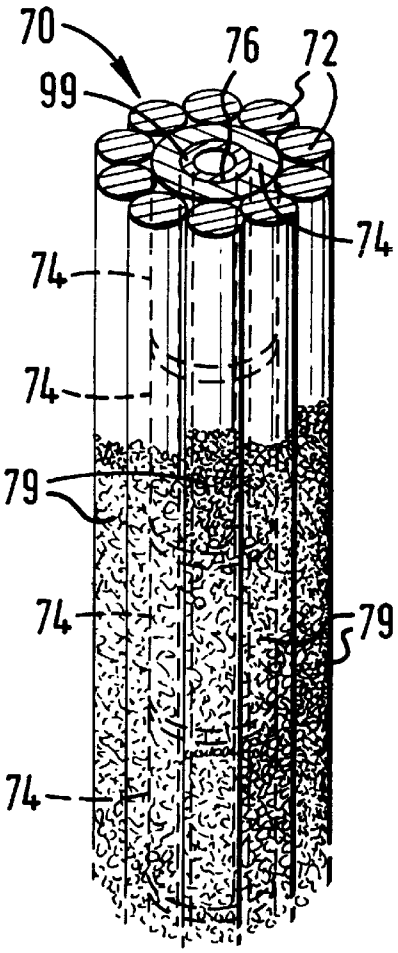
FIG. 6 is a side-perspective view, partially in cross section, of a mill according to the present invention.

FIG. 6 shows a mill 70 according to the present invention with a plurality of wire cables 72 surrounding a plurality of individual cylindrical inner members 74, each with an optimal fluid flow bore 76 therethrough from top to bottom. As shown the individual cylindrical members may be held in position by the cable and/or secured to or adhered to the cable, e.g. with epoxy and/or fasteners so they remain in a spaced-apart configuration. Alternatively, they may be placed one on top of the other. The cables 72 extend from the top of the mill 70 to its bottom. They may be wound around the members 74 in any desired fashion, e.g. but not limited to, helically or they may be substantially straight up and down. Milling material 79 may be applied as shown around the cables 72 or, alternatively, may be applied helically in any desired member helices of any desired wraith. In another aspect, sleeves or other tubulars are secured around the cables and milling material and/or inserts are applied thereto in any known way. The cables are flexible and the use of individual separate inner members also provides flexibility. In one aspect, the inner members between the top and bottom inner member have an outer diameter slightly less than that of the top and bottom inner members for added flexibility. To provide a sealed fluid flow path, as with the various embodiments described above, an inner sealing tube 99 may be used within the inner members 74. Alternatively, a tube may be used on the exterior of the inner members, encompassing all of them.

Figure 7:
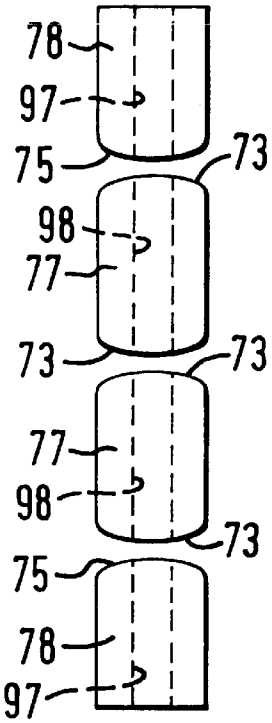
FIG. 7 is a cross-sectional side view of a series of generally cylindrical members fro use in a mill according to the present invention.

FIG. 7 shows an alternative embodiment of inner members 77 and 78 useful with a mill 70. Inner members 78 have a curved surface 75 and inner members 77 have a curved surface 73. Optionally, the inner members 77 and 78 may have fluid flow bores 97, 96 respectively therethrough from top to bottom. Any member 77, 78 may be used in place of any member 74 in the mill 70 of FIG. 6.

Figure 8:
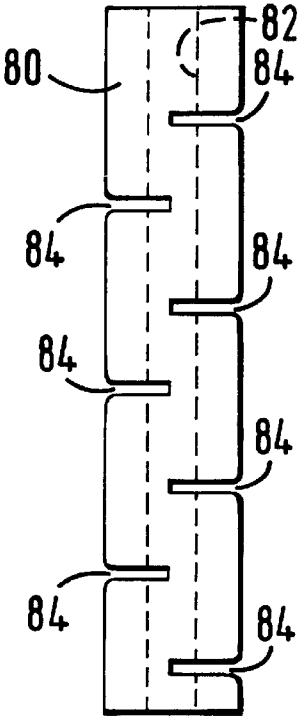
FIG. 8 is a cross-section side view of a generally cylindrical flexible member for use in a mill according to the present invention.

FIG. 8 shows an alternative inner member 80 with an optional fluid flow bore 82 therethrough from top to bottom and a series of cuts 84 which render the inner member 80 flexible (or more flexible if a relatively flexible material is used for the inner member 80). The cuts 84 may be any suitable length and width. Such an inner member 80 may be used as a single inner member for an entire mill or a plurality of inner members 80 of appropriate size may be used within a mill. Alternatively an inner member 80 may be used for any inner member such as the inner members 74 of the mill 70. It is to be understood that a mill 70 may have any desired member of inner members and be any desired length.

Figure 9:
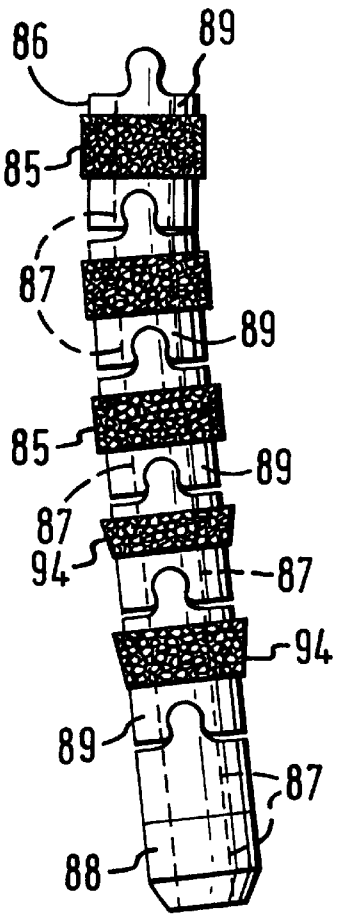
FIG. 9 is a side view of a mill according to the present invention.

FIG. 9 shows a mill 86 according to the present invention with a plurality of movably interconnected articulable members 89 and an end 88. Optionally fluid flow bores 87 extend through each member 89 and the end 88. Milling material 85 is applied around each member 69. Alternatively, such material can be applied helically. As shown, the milling material on the two lowest members 89 is shaped as at 94 to taper inwardly from top to bottom to facilitate entry of the mill into tubulars and to facilitate passage therethrough. Such a tapering configuration can be used with any mill and any milling material disclosed herein, including but not limited to on the structures 20 of the mill of FIG. 1A.

Figure 10:
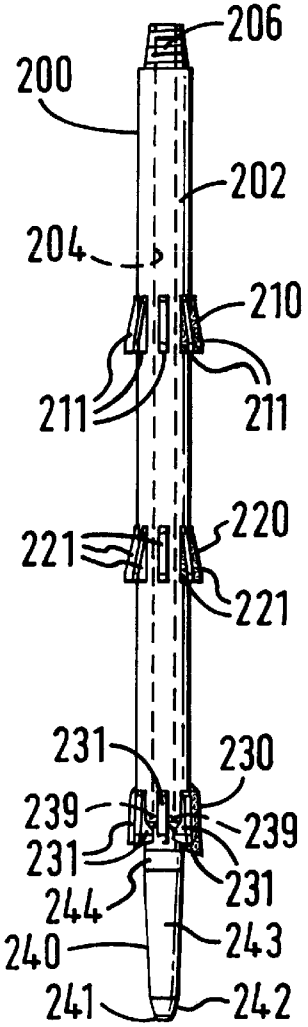
FIG. 10 is a side view of a mill according to the present invention.

FIG. 10 shows a starting mill 200 useful with the mill system for forming an initial window, e.g. in casing in which the system is positioned. The starting mill 200 has a body 202 with a fluid flow channel 204 therethrough (shown in dotted lines). Three sets of cutting blades 210, 220, and 230 with, respectively, a plurality of blades 211, 221, and 231 are spaced apart on the body 202. Jet ports 239 are in fluid communication with the channel 204. A nose 240 projects down from the body 202 and has a tapered end 241, a tapered ramped portion 242, a tapered portion 243, and a cylindrical portion 244. In one aspect the nose is made of readily millable material and is releasably secured to the body 202; e.g. so that it can be twisted off by shearing a shearable member that holds the nose to the body. Then the released nose may be milled by the mill. The nose 240 may have a fluid flow channel therethrough and a flow controlling valve therein.

Referring now to FIGS. 11A–11D, a system 100 according to the present invention has an upper hollow connector or sub 102 interconnected with a tubular string 104 that extends up to the surface in a wellbore 106 cased with casing 108. A stabilizer 110 is connected to one (or more) pieces of drill pipe (or drill collars) 112. A mill 114 is connected to the drill pipe 112. A weight member 116 (optionally with centralizing blades, two or more, not shown) is connected to the mill 112.

Figures 11A, 11B, 11C, 11D:
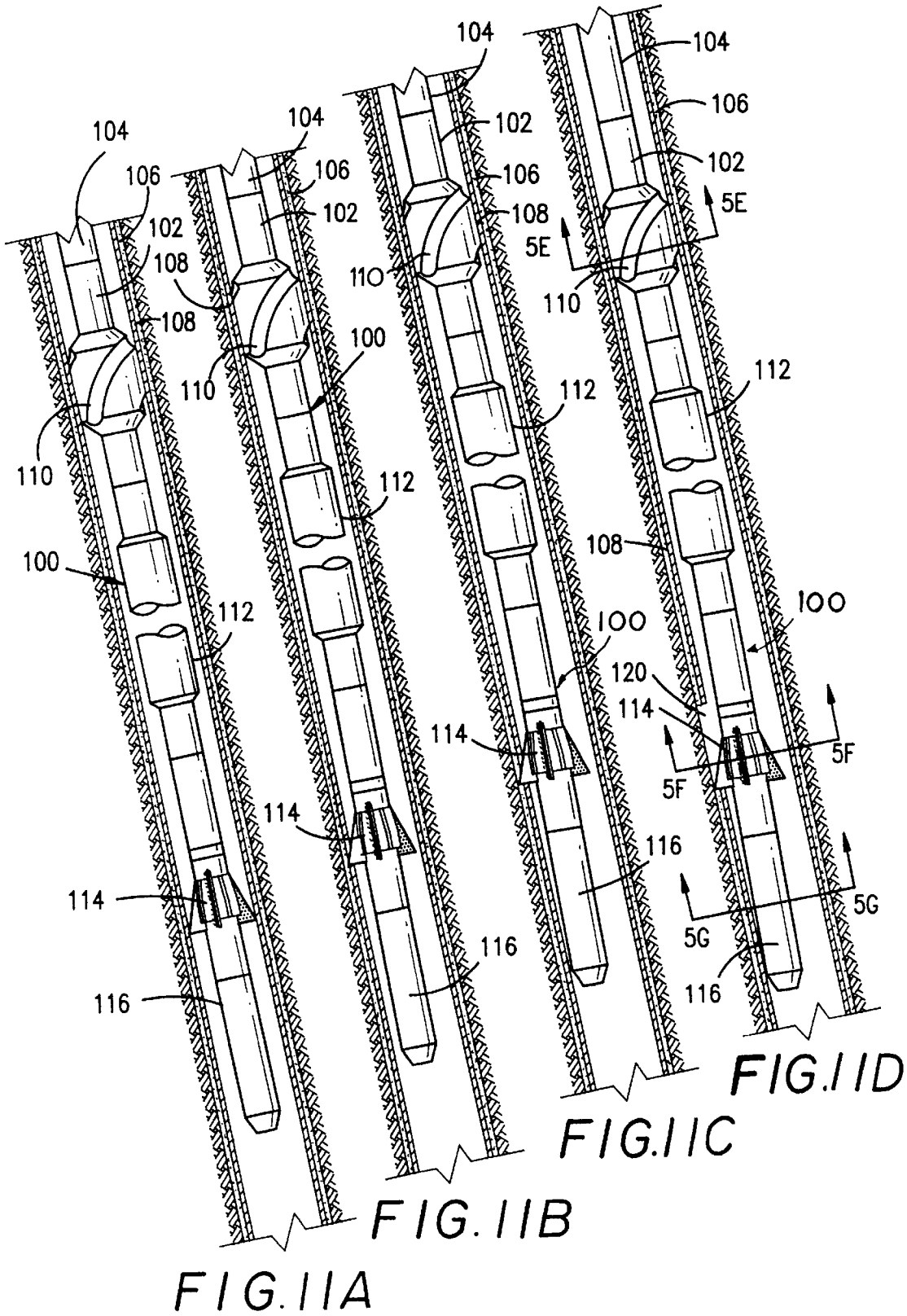
FIGS. 11A–11D show a mill according to the present invention and steps in one method of its use.

As shown in FIG. 11A, the system 100 has been lowered in the casing 108 to a desired location. As shown in FIG. 11B the mill 114 has begun to mill the casing 108. As shown in FIG. 11C the mill 114 has milled through the casing 108 and the weight member 116 has moved off center due, inter alia, to the force of gravity thereby directing the mill 114 against the casing (to the left in FIG. 11C). As shown in FIG. 11D, the mill 114 has milled out an opening or window 120 in the casing 108.

As shown in FIGS. 11A–11D the wellbore 106 is canted from the vertical. It is to be understood that the system 100 is useful in any wellbore in which gravity will act on the weight member 116 to facilitate the directing of the mill against the casing, including, but not limited to, a horizontal wellbore.

Figure 12:
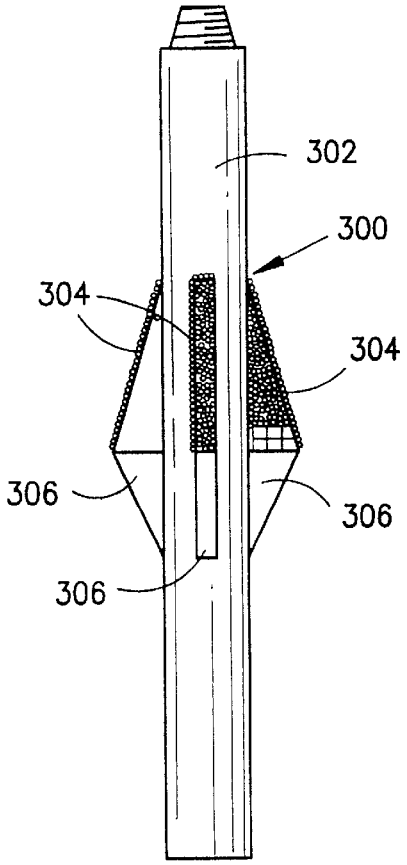
FIG. 12 is a side view of a mill according to the present invention.

FIG. 12 shows a mill 300 according to the present invention with a body 302 and a plurality of blades 304. Associated with each blade 304 is a taper member 306 which is secured to the body 302, or to the blade 304, or to both, either with an adhesive such as epoxy, with connectors such as screws, bolts, or Velcro™ straps or pieces, or by a mating fit of parts such as tongue-and-groove. The taper members may be made of any suitable wood, plastic, composite, foam, metal, ceramic or cermet. In certain embodiments the taper members are affixed to the mill so that upon contact of the lower point of the mill blades with the casing to be milled, the taper members break away so that milling is not impeded.

Figure 13:
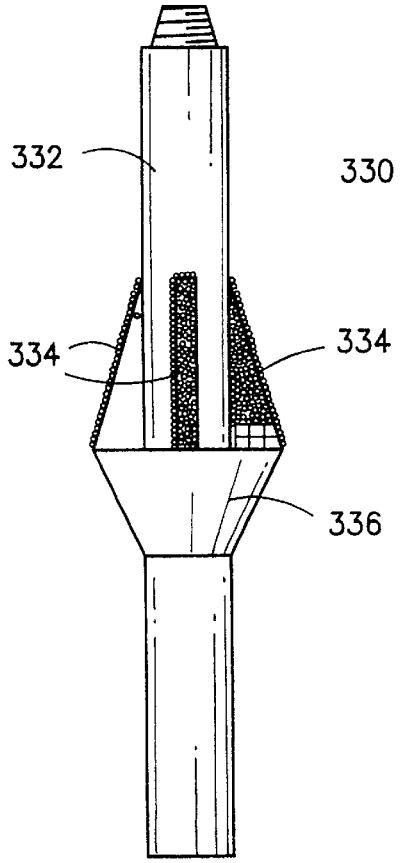
FIG. 13 is a side view of a mill according to the present invention.

FIG. 13 shows a mill 330 according to the present invention with a body 332 and a plurality of blades 334. A taper device 336 is secured around the mill 330 or formed integrally thereon. The taper device 336 extends around the entire circumference of the mill 330 beneath the blades 334 and facilitates movement of the mill 330 through tubulars. The taper device 336 may be a two-piece snap-on or bolt-on device and may be made of the same material as the taper member 306.

Figure 14:
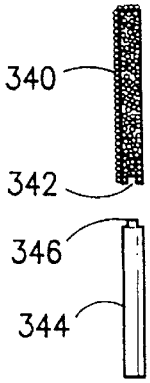
FIG. 14 is a side view of a blade with a taper member according to the present invention.

FIG. 14 shows a blade-taper member combination with a blade 340 having a groove 342 and a taper member 344 with a tongue 346. The tongue 346 is received in the groove 342 to facilitate securement of the taper member 344 to the blade 340. Optionally, an epoxy or other adhesive may be used to glue the taper member to the blade, to a mill body, or to both. The tongue and groove may be dovetail shaped.

Figure 15:
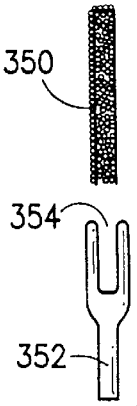
FIG. 15 is a side view of a blade with a taper member according to the present invention.

FIG. 15 shows a blade-taper member combination with a blade 350 and a taper member 352 with a recess 354. The blade 350 is received in and held in the recess 354. Optionally an adhesive may be used to enhance securement of the taper member 352 to the blade, to the mill, or to both.

Figure 16:
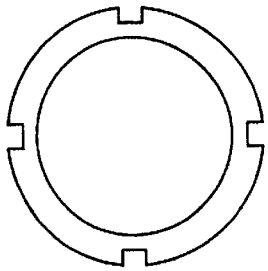
FIG. 16 is a bottom view of a mill body according to the present invention.

FIG. 16 shows a mill body 370 like the bodies of the mills shown in FIG. 5A, 10, and 11 of pending U.S. Application Ser. No. 08/642,118 filed May 2, 1996, but with a series of grooves 372 therein which extend longitudinally on the mill body and are sized, configured, and disposed to receive and hold a taper member as shown in FIG. 12, FIG. 14, or FIG. 15. Such a mill body may be used instead of or in combination with any previously-described taper securement means.

Figure 17:
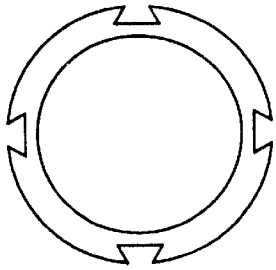
FIG. 17 is a bottom view of a mill body according to the present invention.

FIG. 17 shows a mill body 380 like the bodies of the mills shown in FIGS. 5A, 10, and 11 of pending U.S. Application Ser. No. 08/642,118 filed May 2, 1996, but with a series of dovetail grooves 382 therein which extend longitudinally on the mill body and are sized, configured, and disposed to receive and hold a taper member as shown in FIG. 12, FIG. 14, or FIG. 15. Such a mill body may be used instead of or in combination with any previously-described taper securement means.

Figure 18:
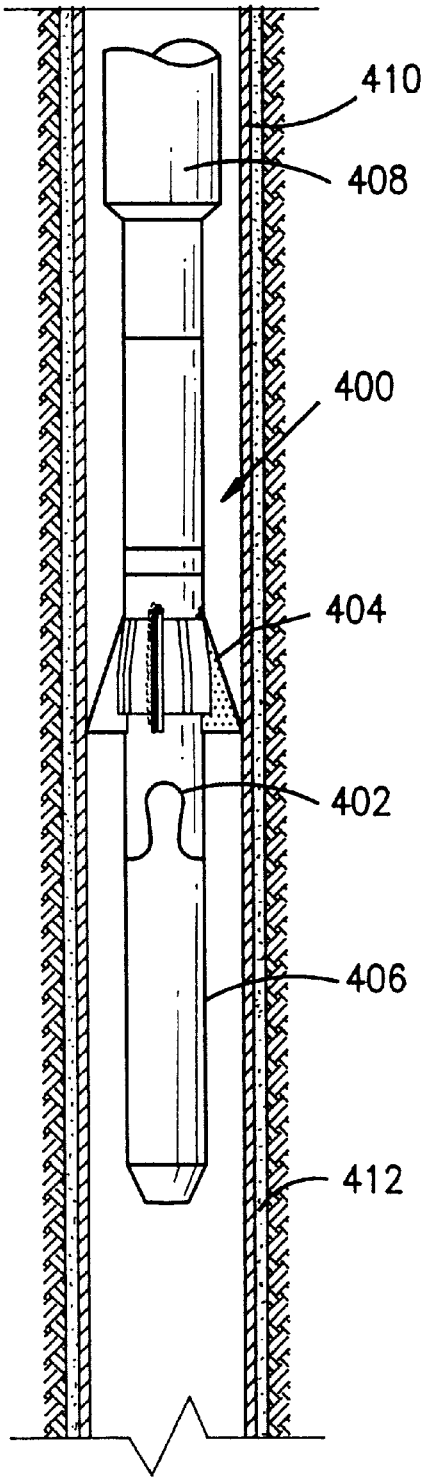
FIG. 18 is a side view of a system according to the present invention.

FIG. 18 shows a system 400 like previously described systems, but with a flexible connection 402 between a mill 404 and a weight member 406. The flexible connection permits pivoting of the weight member 406 with respect to the mill 404 in response to the force of gravity. The mill 404 is connected to a tubular string 408 which extends up to the surface (not shown) in a casing string 410 in a wellbore 412. Flexible connections are well known, see e.g. U.S. Pat. No. 4,699,224. Alternatively a ball-and-socket joint may be used or a knuckle-joint, see also U.S. Pat. No. 4,699,224.

Figure 19:
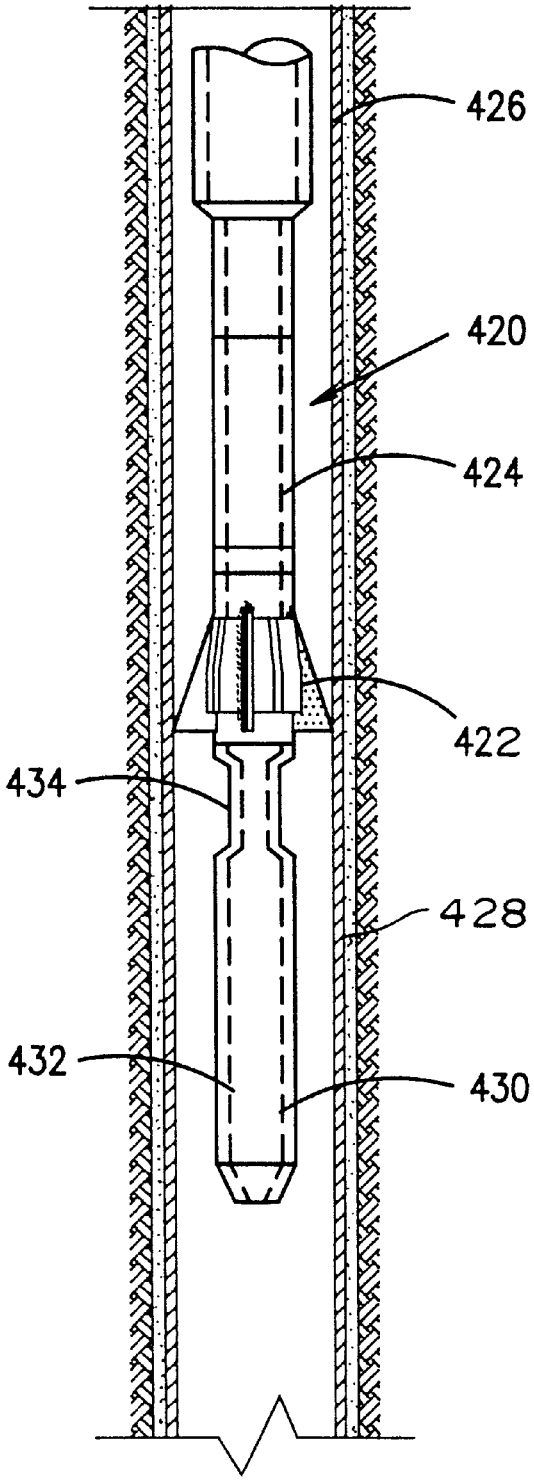
FIG. 19 is a side view of a system according to the present invention.

FIG. 19 shows a system 420 with a mill 422 connected to a tubular string 424 which extends to the surface (not shown) through a casing string 426 in a wellbore 428. A weight member 430 connected to the mill 422 has a body 432 with a flexible neck 434 which permits the weight member to move toward a bottom side of the casing in response to the force of gravity. Additional weights or fluid may be added to the weight member 430 as described for previous embodiments.

It is seen, therefore, that the present invention discloses a wellbore mill with a flexible main body, and at least one milling apparatus secured on the flexible main body; such a mill wherein the flexible main body is a multi-strand metal cable; such a mill wherein the at least one milling apparatus is a plurality of spaced-apart milling apparatuses; such a mill wherein the at least one milling apparatus is a sleeve secured around the flexible main body, and there is matrix milling material on an exterior surface of the sleeve; such a mill wherein the flexible main body is a multi-strand cable and the wellbore mill has an articulable member within and surrounded by strands of the multi-strand cable; any such mill wherein the articulable member is hollow and provides a fluid flow bore through the flexible main body; any such mill wherein the articulable member has a series of spaced-apart cuts therein that render the articulable member articulable; any such mill further comprising a weight member connected to a bottom end of the flexible main body; any such mill with a hollow tubular with a fluid flow bore therethrough and extending through the flexible main body from a top to a bottom thereof providing a fluid flow passage through the mill; any such mill with a hollow flexible liner surrounding the articulable member within the multi-strand cable; any such mill with a flexible hollow liner within the fluid flow bore of the hollow tubular; any such mill wherein the flexible main body has a top and a bottom, a threaded top sub connected to the top of the flexible main body, a threaded bottom sub connected to the bottom of the flexible main body, and the threaded subs provide releasable emplacement of the wellbore mill in a wellbore tubular string; any such mill with a fishing member at a top of the main body; any such mill wherein the flexible main body comprises a series of individual generally cylindrical members; any such mill wherein the individual generally cylindrical members are spaced apart; any such mill wherein the at least one milling apparatus includes a tapered portion tapering inwardly from top to bottom to facilitate passage of the wellbore mill through a hollow tubular in a wellbore; and any such mill wherein the milling apparatus includes matrix milling material with the tapered portion.

The present invention discloses a wellbore mill with a mill body with a top end and a bottom end, at least one milling structure on the mill body, and a stinger projecting down from and releasably secured to the bottom end of the mill body, which, in one aspect is sufficiently long to facilitate positioning of the mill with respect to a previously milled-out portion of an offset; any such mill wherein the mill body has a bore therein, a shear pin releasably holds the stinger to the mill body, and wherein shearing of the shear pin releases the stinger for movement up into the bore of the mill body during milling by the wellbore mill; such a mill wherein the bore of the mill body extends through the wellbore mill from top end to bottom end of the mill body.

The present invention discloses a method for eliminating tubular offset in a wellbore, the method including positioning a wellbore mill in a tubular offset of a tubular string in a wellbore, the wellbore mill like any flexible mill disclosed herein and, in one aspect, with a flexible main body and at least one milling apparatus secured on the flexible main body, and rotating the wellbore mill to mill at least part of the tubular offset; such a method wherein the wellbore mill further comprises a hollow tubular with a fluid flow bore therethrough and extending through the flexible main body from a top to a bottom thereof providing a fluid flow passage through the mill, the method also including circulating fluid through and out from the wellbore mill during milling; any such method including removing the wellbore mill from the tubular offset and from the wellbore, and introducing a secondary mill system into the wellbore and locating it with respect to the tubular offset, the secondary mill system comprising a secondary mill body with a top end and a bottom end and at least one milling structure thereon, and a stinger projecting down from and releasably secured to the bottom end of the secondary mill body, and further milling the tubular at the tubular offset with the secondary mill system; any such method wherein the mill body has a bore therein, a shear pin releasably holds the stinger to the mill body, and wherein shearing of the shear pin releases the stinger for movement up into the bore of the mill body during milling by the wellbore mill, and the method including shearing the shear pin, and during milling swallowing the stinger in the bore of the mill body; and any such method wherein the wellbore mill has a fluid flow bore therethrough and the method including circulating fluid through the wellbore mill and out therefrom into a wellbore annulus during milling.

The present invention discloses a method for milling a tubular in a wellbore, the method including introducing a mill into the wellbore, the mill comprising a flexible main body, and at least one milling apparatus secured on the flexible main body, locating the mill with respect to a tubular to be milled, and milling the tubular with the mill by rotating the mill.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A wellbore mill comprising a flexible main body, wherein the flexible main body is a multi-strand cable and an articulable member within and surrounded by strands of the multi-strand cable.

2. The wellbore mill of claim 1 wherein the articulable member is hollow and provides a fluid flow bore through the flexible main body.

3. The wellbore mill of claim 2 wherein the articulable member has a series of spaced-apart cuts therein that render the articulable member articulable.

4. A method for eliminating tubular offset in a wellbore, the method comprising positioning a wellbore mill in a tubular offset of a tubular string in a wellbore, the wellbore mill comprising a flexible main body and at least one milling apparatus secured on the flexible main body, rotating the wellbore mill to mill at least part of the tubular offset, removing the wellbore mill from the tubular offset and from the wellbore, introducing a secondary mill system into the wellbore and locating it with respect to the tubular offset, the secondary mill system comprising a secondary mill body with a top end and a bottom end and at least one milling structure thereon, and a stinger projecting down from and releasably secured to the bottom end of the secondary mill body, and further milling the tubular at the tubular offset with the secondary mill system.

5. The method of claim 4 wherein the wellbore mill further comprises a hollow tubular with a fluid flow bore therethrough and extending through the flexible main body from a top to a bottom thereof providing a fluid flow passage through the mill, the method further comprising circulating fluid through and out from the wellbore mill during milling.

6. The method of claim 4 wherein the mill body has a bore therein, a shear pin releasably holds the stinger to the mill body, and wherein shearing of the shear pin releases the stinger for movement up into the bore of the mill body during milling by the wellbore mill, and the method further comprising shearing the shear pin, and during milling swallowing the stinger in the bore of the mill body.

7. The method of claim 4 wherein the wellbore mill has a fluid flow bore therethrough and the method further comprising circulating fluid through the wellbore mill and out therefrom into a wellbore annulus during milling.

8. A wellbore mill comprising a flexible main body wherein the flexible main body is a multi-strand metal cable, at least one milling apparatus secured on the flexible main body, the flexible main body having a top and a bottom, a threaded top sub connected to the top of the flexible main body, a threaded bottom sub connected to the bottom of the flexible main body, and the threaded subs for releasable emplacement of the wellbore mill in a wellbore tubular string.

9. The wellbore mill of claim 8 wherein the at least one milling apparatus is a plurality of spaced-apart milling apparatuses.

10. The wellbore mill of claim 8 wherein the at least one milling apparatus comprises a sleeve secured around the flexible main body, and matrix milling material on an exterior surface of the sleeve.

11. The wellbore mill of claim 8 further comprising an articulable member within and surrounded by strands of the multi-strand cable.

12. The wellbore mill of claim 11 wherein the articulable member is hollow and provides a fluid flow bore through the flexible main body.

13. The wellbore mill of claim 12 wherein the articulable member has a series of spaced-apart cuts therein that render the articulable member articulable.

14. The wellbore mill of claim 12 further comprising a hollow flexible liner surrounding the articulable member within the multi-strand cable.

15. The wellbore mill of claim 12 further comprising a flexible hollow liner within the fluid flow bore of the hollow tubular.

16. The wellbore mill of claim 8 further comprising a fishing member at a top of the main body.

17. The wellbore mill of claim 8 wherein the flexible main body comprises a series of individual generally cylindrical members.

18. The wellbore mill of claim 17 wherein the individual generally cylindrical members are spaced apart.

19. The wellbore mill of claim 8 wherein the at least one milling apparatus includes a tapered portion tapering inwardly from top to bottom to facilitate passage of the wellbore mill through a hollow tubular in a wellbore.

20. The wellbore mill of claim 19 wherein the milling apparatus includes matrix milling material with the tapered portion.

21. A wellbore mill comprising a flexible main body, at least one milling apparatus secured on the flexible main body, the flexible main body having a top and a bottom, a threaded top sub connected to the top of the flexible main body, a threaded bottom sub connected to the bottom of the flexible main body, and the threaded subs for releasable emplacement of the wellbore mill in a wellbore tubular string, and a weight member connected to a bottom end of the flexible main body.

22. A wellbore mill comprising a flexible main body, at least one milling apparatus secured on the flexible main body, the flexible main body having a top and a bottom, a threaded top sub connected to the top of the flexible main body, a threaded bottom sub connected to the bottom of the flexible main body, and the threaded subs for releasable emplacement of the wellbore mill in a wellbore tubular string, and a hollow tubular with a fluid flow bore therethrough and extending through the flexible main body from a top to a bottom thereof providing a fluid flow passage through the mill.

23. A method for eliminating tubular offset in a wellbore, the method comprising positioning a wellbore mill in a tubular offset of a tubular string in a wellbore, the wellbore mill comprising a flexible main body and at least one milling apparatus secured on the flexible main body, the flexible main body having a top and a bottom, a threaded top sub connected to the top of the flexible main body, a threaded bottom sub connected to the bottom of the flexible main body, and the threaded subs for releasable emplacement of the wellbore mill in a wellbore tubular string, rotating the wellbore mill to mill at least part of the tubular offset, wherein the wellbore mill further comprises a hollow tubular with a fluid flow bore therethrough and extending through the flexible main body from a top to a bottom thereof providing a fluid flow passage through the mill, the method further comprising circulating fluid through and out from the wellbore mill during milling.

24. The method of claim 23 further comprising removing the wellbore mill from the tubular offset and from the wellbore, introducing a secondary mill system into the wellbore and locating it with respect to the tubular offset, the secondary mill system comprising a secondary mill body with a top end and a bottom end and at least one milling structure thereon, and a stinger projecting down from and releasably secured to the bottom end of the secondary mill body, and further milling the tubular at the tubular offset with the secondary mill system.

25. The method of claim 24 wherein the mill body has a bore therein, a shear pin releasably holds the stinger to the mill body, and wherein shearing of the shear pin releases the stinger for movement up into the bore of the mill body during milling by the wellbore mill, and the method further comprising shearing the shear pin, and during milling swallowing the stinger in the bore of the mill body.

26. The method of claim 23 wherein the wellbore mill has a fluid flow bore therethrough and the method further comprising circulating fluid through the wellbore mill and out therefrom into a wellbore annulus during milling.

27. A method for milling a tubular in a wellbore, the method comprising introducing a mill into the wellbore, the mill comprising a flexible main body wherein the flexible main body is a multi-strand metal cable, and at least one milling apparatus secured on the flexible main body, the flexible main body having a top and a bottom, a threaded top sub connected to the top of the flexible main body, a threaded bottom sub connected to the bottom of the flexible main body, and the threaded subs for releasable emplacement of the wellbore mill in a wellbore tubular string, locating the mill with respect to a tubular to be milled, and milling the tubular with the mill by rotating the mill.

* * * * *